US006243876B1

(12) United States Patent
Provenzano et al.

(10) Patent No.: US 6,243,876 B1
(45) Date of Patent: Jun. 12, 2001

(54) KOOL CAP

(76) Inventors: Lloyd Provenzano, 8345 Excalibur Cir., Unit M5, Naples, FL (US) 34108; Rashida Karmali, 13 W. 13th St. Apt. 3AN, New York, NY (US) 10011

( * ) Notice: Subject to any disclaimer, the term of this patent is extended or adjusted under 35 U.S.C. 154(b) by 0 days.

(21) Appl. No.: 09/365,688

(22) Filed: Aug. 2, 1999

(51) Int. Cl.[7] ..... A42B 1/06
(52) U.S. Cl. ..... 2/172; 2/DIG. 19.1; 2/171
(58) Field of Search ..... 2/DIG. 19, 171, 2/171.3, 172, 184.5, 175.1, 209.12, 195.1

(56) References Cited

U.S. PATENT DOCUMENTS 2,697,832 * 12/1954 Stitch ..... 2/DIG. 1
4,101,981 7/1978 Boden .
5,101,516 4/1992 Scarnato .
5,303,424 * 4/1994 Cromartie ..... 2/67
5,487,191 * 1/1996 Ridley ..... 2/195.1
5,495,622 * 3/1996 Kaufman ..... 2/175.1
5,642,526 * 7/1997 Thompson ..... 2/79
5,704,064 * 1/1998 Van Der Sleesen ..... 2/69
5,839,121 * 11/1998 Morales ..... 2/7

* cited by examiner

*Primary Examiner*—Bibhu Mohanty
(74) *Attorney, Agent, or Firm*—Rashida A. Karmali

(57) ABSTRACT

A venting head wear containing at least one and, ordinarily, multiple apertures in the material of the cap, which are flanked by a set of differently shaped and sized flaps, which create circulation of air through the wearer's hair and scalp during activity involving motion and windy conditions. The air flow creates a cooling effect and prevents perspiration from wetting the scalp and forehead. An added advantage of the kool cap is the delightful feeling of coolness and motion caused by the movement of flaps waving, undulating and

1 Claim, 3 Drawing Sheets

KOOL CAP

BACKGROUND OF THE INVENTION

The present invention relates to a system for cooling and/or drying the head, scalp, hair and forehead region during hot temperatures, sunny days, on days with a high ultra-violet index and/or during sporting or physically exerting activity.

More particularly, the system comprises a cap or head wear comprising a plurality of venting means for creating air flow and moisture (or perspiration) evaporation through multiple elements aesthetically designed in the cap or system and creating a cooling effect thereby eliminating the need of said cap or system to be removed during the activity for ventilation.

The present invention also relates to a system for protecting the scalp and any medicament or cream that may be applied to said scalp, said system comprising a cap or head wear having an additional layer of aerated, perforated, gauze-like material forming the underlining of the cap or head wear.

The relevant art describes various hats and caps which are cooled by various means. The creation of perspiration along the brow band of a cap during hot summer months or during exertion of intense physical activity has been a long standing problem. Just as covering the head region with a wool cap provides shelter to and conserves heat in the scalp and head region in harsh and severely cold temperatures in winter, the creation of a venting or cooling system during heat generating activities and/or hot temperatures, has been a long standing problem. Elaborate means of eliminating the formation of perspiration along a sweat band of a cap or sun visor, or means of ventilating a sportsman's head by use of air funnels mounted through apertures positioned in the cap, have been proposed. To date, no simple solution has been provided that would permit air cooling of the scalp and head region during sustained physical activity or during warm or reasonably hot temperature conditions.

For example, U.S. Pat. No. 5,01,516 issued on Apr. 7, 1992 to Thomas J. Scarnato describes a system for ventilating the brow band area of a cap or sun visor which seats against the forehead of the wearer. The system includes a plurality of porous, absorbent spacer elements which are secured to the interior surface of a sweat band to absorb the perspiration from the forehead which may develop.

U.S. Pat. No. 4,101,981 discloses a cap made of non-ventilating materials which includes ventilation openings including a top opening beneath which a baffle is movably supported. The band of the cap has two rigid, horizontally spaced elements which engage the user's head at different locations to hold the band away from at least the front and side portions of the user's head and with the band containing one or more stiffening members for maintaining the shape of the band while thus spaced from the head.

As will be described in greater detail hereinafter, none of the above inventions and patents, taken either singly or in combination, is seen to describe the present invention which includes a plurality of venting means for creating air flow and moisture evaporation through multiple elements in the body of the cap or head gear system, and creates a cooling, comforting effect, thereby eliminating the need of removing the cap during the activity for ventilation.

SUMMARY OF THE INVENTION

According to the invention there is provided a system for cooling and/or drying the head, scalp, hair and forehead region during hot temperatures and/or during sporting or physically exerting activity. The system includes a plurality of venting means for creating air flow, evaporating the perspiration or any moisture through multiple elements aesthetically designed in the cap or system, and creating a cooling, comfortable effect, thereby eliminating the need to remove the cap or system for ventilation.

Specifically, the invention is a ventilating cap or system with a multiple of elements designed to ventilate a wearer's scalp during physical activity or warm temperature. The elements comprise of a multiple of aesthetically shaped, flexible flaps designed in the body of the cap or system and bordering a corresponding multiple of flow-through apertures or venting elements. The flexible flaps create an aesthetically desirable canopy of elements which create a fanning effect during motion, breezy or windy conditions, thereby creating a cooling air flow through the cap. The added advantage is evaporation of perspiration or moisture from the scalp and hair region, which further cools the forehead of the wearer.

Accordingly, it is an object of the invention to provide a cap or system which creates a cooling air flow for the wearing during warm temperatures or during sporting activity including, but not limited to, running, bicycling, roller blading and gliding, baseball, football, tennis or the like, to counteract the overheating of the wearer's head.

It is another object of the invention to provide an air-cooled cap or system which distributes the flowing air directly over the scalp and through the hair.

It is a further object of the invention to provide an air cooled cap or system with flapping elements which are designed in varying shapes and sizes in the body of the cap or system.

Still another object of the invention is to provide an air-cooled cap or system with a multiple of elements comprising perforations of different shapes and sizes, designed in the body of the cap or system, with or without flaps covering the perforation.

Yet another object of the invention is to provide the open perforating elements with insect blocking screens.

Still another object of the invention is to provide a cap or system having a multiple of perforations which allow evaporation of perspiration or moisture from the wearer's head.

It is an object of the invention to provide improved elements and novel arrangements thereof in a system for the purposes described, which is inexpensive, fully effective in accomplishing its intended objects and aesthetically appealing to individuals of all ages.

It is also an object of the invention to provide a system for comfortable, aesthetically appealing head wear having a multiple of perforations in the top lining of the system, and including second layer beneath it which protects the scalp or any material applied to the scalp, such second layer being permanently attached to the head wear or being disposable.

These and other objects of the present invention will become readily apparent upon further review of the following specification and drawings.

DETAILED DESCRIPTION OF THE PREFERRED EMBODIMENTS

Description of the Preferred Embodiments

With reference to the drawings, and in particular to FIGS. 1–6 thereof, a new ventilating head wear embodying the principles and concepts of the present invention and generally referred to as the "kool cap" 12 is described. The "kool cap" as used in the present invention represents a head wear in which a variety of flaps are cut-out in the fabric of the head wear, thereby creating apertures or passageways through which air is allowed to flow through the hair and scalp area and brings about a cooling and comfortable sensation.

Figure 1:
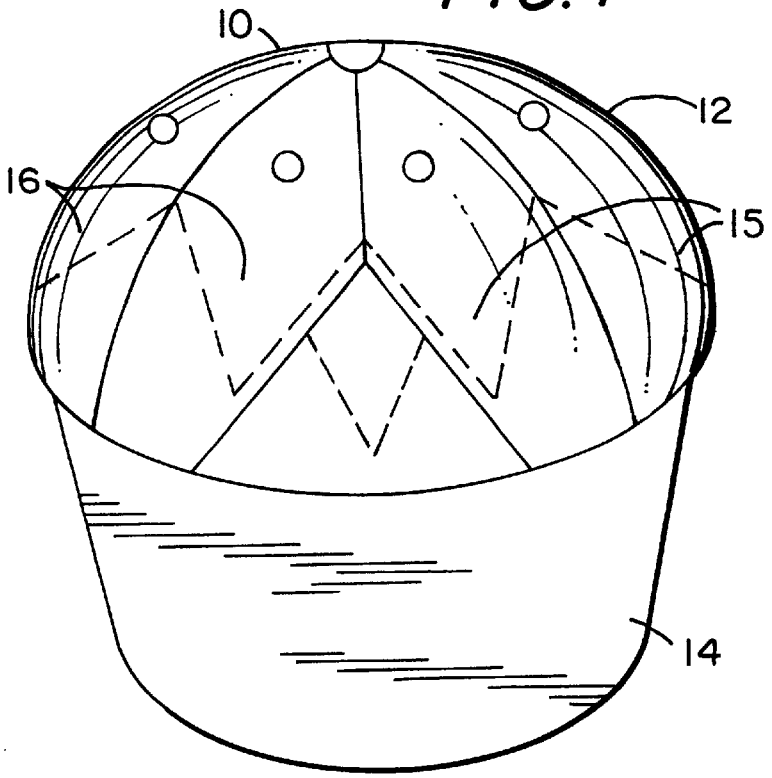
FIG. 1 shows a front view of a first embodiment of a cap shown with a design comprising a multiple of single flaps shown in dotted lines where the material is cut.
Figure 2:
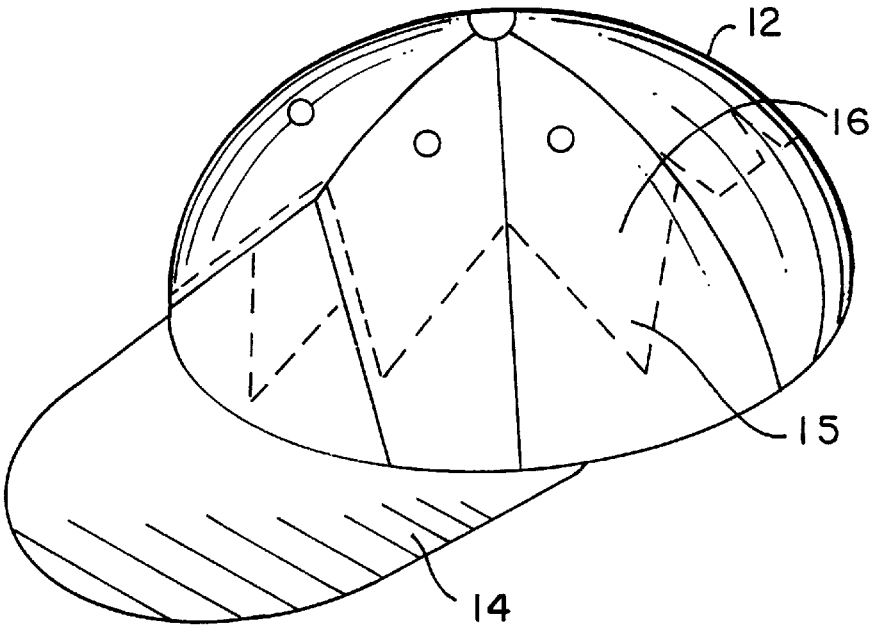
FIG. 2 shows a side view of the first embodiment of a cap having a multiple of single flaps.
Figure 3:
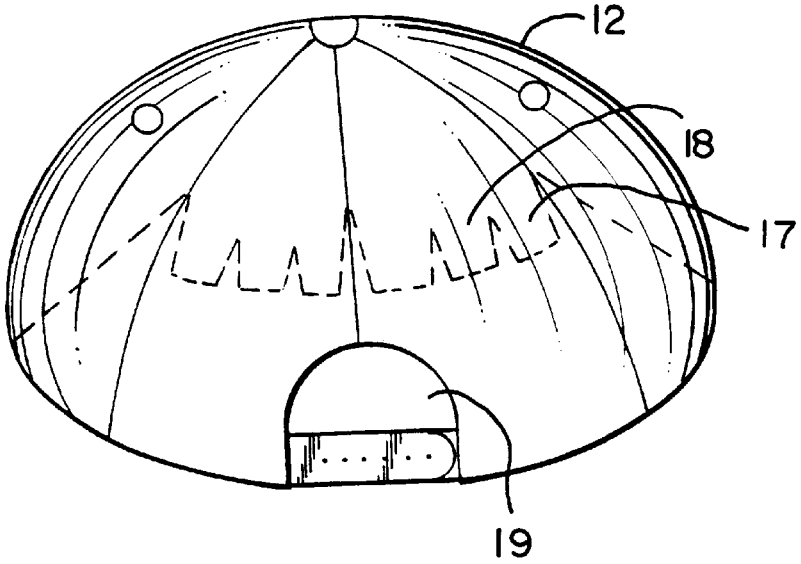
FIG. 3 shows a back view of the first embodiment of a cap with a multiple of perforating elements, contrasting in size and shape from elements on the front and size of the cap.

A first form of embodying the invention is illustration in FIGS. 1–3, and includes a cap 12 which may be positioned about or upon the head of an individual. A visor 14 extends from the cap 12 and is operable to preclude the direct impinging light upon the individual's eyes.

More specifically, the venting cap system comprises a cap 12 comprising of a multiple of flaps 15 extending from the cap 12 and are operable to permit air to more freely through the apertures 16 in the cap 12. The apertures 16 allow a passage of air through the cap 12 by oncoming wind currents, such as encountered during walking, running, bicycling or riding in an open vehicle. Although not specifically illustrated, the cap 12 of the present invention is not limited to a sports cap, but includes a baseball hat, a helmet, a fishing cap, a cowboy hat, rain hat, golf hat, tub hats, soft caps, made partly with or without the stiffener, a classic hat, or a head wear of any conceivable configuration. The present invention also includes body wear which is designed to create a venting system in any conceivable part of the body including, but not limited to, T-shirts, knitwear, shirts, jeans, pants or casual clothing.

FIGS. 1—3 describe a cap with individual single flaps 15 cut-out along the dotted lines. Each flap 15 may therefore remain attached to the cap 12 at region x—x or in the alternative, attached externally over the region x—x which may still be cut to create an aperture 16. Each flap 15 may move freely when confronted with air currents and allow air to freely flow through the aperture. Each flap 15 may wave, flutter or double over while affixed to cap 12. FIG. 2 describes a side view of cap 12, in which the design using the single flap 15 is continued, such that two-thirds of the perimeter of cap 12 is included in such design. FIG. 3 describes the back view of cap 12 wherein the design for flap 15 may be similar to that described above or may be charged to a triple flap design 17, overlaying a multiple of apertures 18 on the back view of cap 12. The back of cap 12 includes an enlarged aperture 19 which permits flow of air from the posterior direction.

Figure 4:
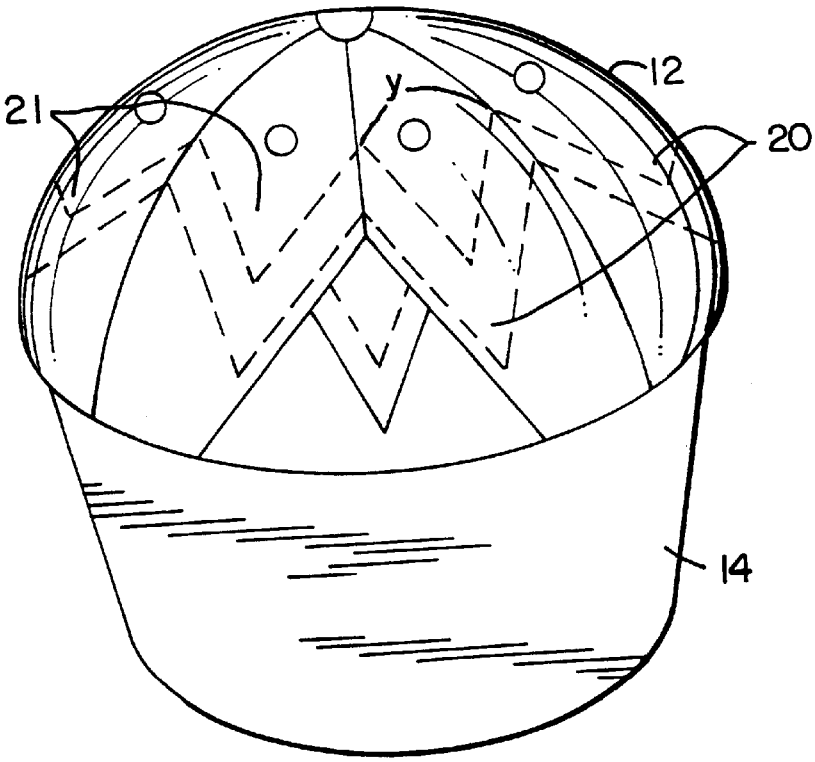
FIG. 4 shows the front view of the seemed embodiment having a multiple of double flaps shown in dotted lines where the material.
Figure 5:
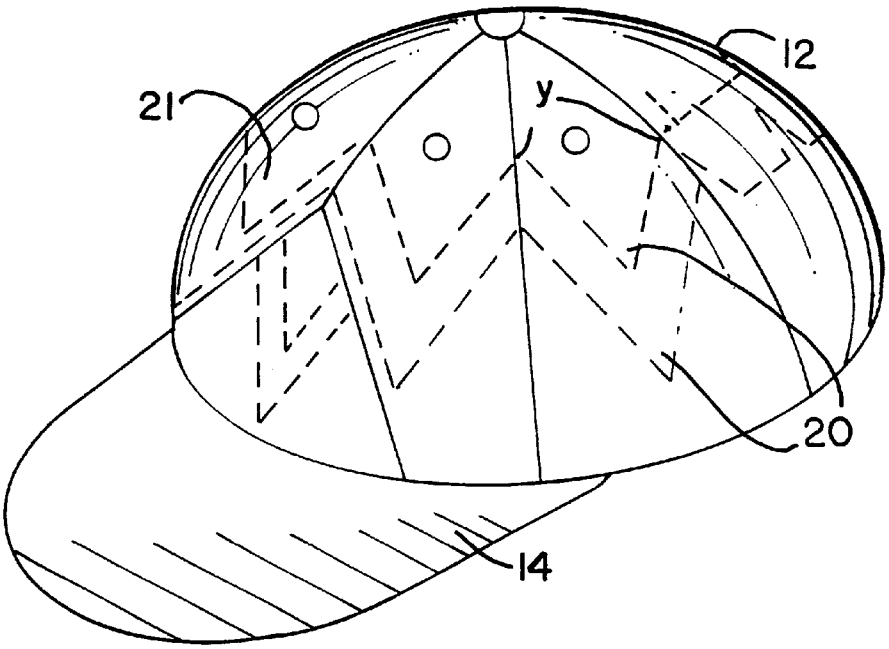
FIG. 5 shows a side view of the second embodiment of a cap having a multiple of double flaps.
Figure 6:
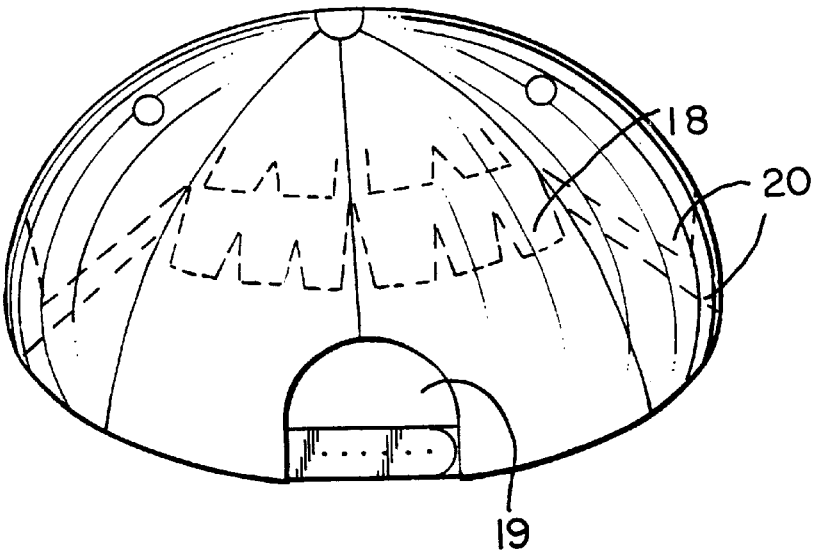
FIG. 6 shows a back view of the second embodiment of a cap with a multiple of perforating elements, contrasting in size and shape from elements on the front and side of the cap.

FIGS. 4–6 describe an embodiment of the invention which includes a cap 12 which may be positioned about or upon the head of a subject. Cap 12 comprises a multiple of double flaps 20 which may be cut out in the material of cap 12 or which may be attached at positions Y—Y in cap 12, and overlaying a set of apertures 21. The double-flaps are designed such that they freely flip-up or reverse effortlessly, creating a feeling of action and motion that appeals to the young and adult users alike, especially those that ascribe a care-free and active lifestyle. The kool cap additionally provides an excellent circulation through the apertures, hair and scalp of the wearer including an athlete, farmer, landscaper, builder, utility service provider, or any individual involved in physically exerting activities or working in the sun. The double flap design 20 may also be particularly useful in creating a military camouflage in Cap 12 or any other part of the military uniform. The design of the flap may be varied in shape, size, color, patchwork or material. The flaps may be semi-attached, hang freely or could be secured in part or fully by searing means, for example, straps, snaps, zippers, Velcro or other means.

What is claimed is:

1. A hat for creating ventilation comprising a crown portion with a visor, said hat further comprising at least first and second rows of generally triangular shaped vent openings placed over a substantial portion of front and sides of the crown portion, said hat further comprising another row of generally rectangular shaped vent openings on the rear of the hat crown.

* * * * *